US007500873B1

(12) United States Patent
Hart

(10) Patent No.: US 7,500,873 B1
(45) Date of Patent: Mar. 10, 2009

(54) SNAP-ON COAXIAL CABLE CONNECTOR

(75) Inventor: Dennis Francis Hart, Phoenix, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/152,692

(22) Filed: May 16, 2008

(51) Int. Cl.
*H01R 9/05* (2006.01)

(52) U.S. Cl. ..... 439/578; 439/63; 439/350; 439/610

(58) Field of Classification Search ..... 439/63, 439/650, 353, 557, 578–585, 610
See application file for complete search history.

(56) References Cited

U.S. PATENT DOCUMENTS

| | | | | |
|---|---|---|---|---|
| 4,717,355 | A * | 1/1988 | Mattis | 439/452 |
| 4,772,222 | A * | 9/1988 | Laudig et al. | 439/578 |
| 5,393,244 | A * | 2/1995 | Szegda | 439/394 |
| 5,488,268 | A * | 1/1996 | Bauer et al. | 315/70 |
| 5,906,511 | A * | 5/1999 | Bozzer et al. | 439/579 |
| 6,705,875 | B2 * | 3/2004 | Berghorn et al. | 439/63 |
| 6,780,042 | B1 * | 8/2004 | Badescu et al. | 439/352 |
| 6,827,608 | B2 | 12/2004 | Hall et al. | 439/578 |
| 6,935,866 | B2 * | 8/2005 | Kerekes et al. | 439/63 |
| 7,077,697 | B2 | 7/2006 | Kooiman | 439/557 |
| 7,118,382 | B2 * | 10/2006 | Kerekes et al. | 439/63 |
| 7,128,604 | B2 | 10/2006 | Hall | 439/578 |
| 7,165,974 | B2 | 1/2007 | Kooiman | 439/63 |
| 7,192,308 | B2 * | 3/2007 | Rodrigues et al. | 439/578 |
| 7,288,002 | B2 * | 10/2007 | Rodrigues et al. | 439/578 |
| 7,357,641 | B2 * | 4/2008 | Kerekes et al. | 439/63 |
| 2006/0246774 | A1 * | 11/2006 | Buck | 439/578 |
| 2007/0004276 | A1 | 1/2007 | Stein | 439/578 |

* cited by examiner

*Primary Examiner*—James Harvey
(74) *Attorney, Agent, or Firm*—Matthew J. Mason

(57) ABSTRACT

A coaxial transmission connector is provided that includes a housing and a plurality of fingers extending from the first end of the housing. The connector can be mated with a mating connector interface, which can be disposed in a bore extending within a multiple-position connector assembly. Methods for attaching a coaxial cable to a coaxial transmission connector and for mating the connector with the mating connector interface are also provided.

19 Claims, 3 Drawing Sheets

SNAP-ON COAXIAL CABLE CONNECTOR

BACKGROUND OF THE INVENTION

1. Field of the Invention

The present invention relates generally to electrical connectors, and particularly to an electrical connector having a push-on style interface, which can be snapped into a panel interface.

2. Technical Background

Microwave connectors having a push-on style interface such as a subminiature push-on ("SMP") interface and a SMP-miniature ("SMPM") interface, as described in MIL-STD-348A, are known. Microwave connectors having a port with a push-on style interface designed to connect a coaxial cable to a printed wiring board ("PWB") are also known. Known single-position microwave connectors having a push-on style interface have a cable adaptor that is press-fit into the connector body, thereby disadvantageously being thermally integral with the connector body, which can slow the process of soldering a coaxial cable to the cable adaptor. In addition, a plurality of coaxial cables cannot be uncoupled from a plurality of single-position connectors with a single action.

Accordingly, multiple-position push-on electrical connectors have been designed to overcome at least one of the disadvantages of single-position connectors. Some multiple-position coaxial cable connectors have a provision for the individual coaxial cable and connector to be field replaceable. Such connectors typically have a spring-action snap ring, a plastic insert, and a lip on the connector. Such connectors are disadvantageously relatively large-usually about two inches in diameter.

Other multiple-position push-on connectors involve soldering the outer conductor of a coaxial cable directly onto the connector. With normal use (bending, twisting, and pulling) the soldered-outer conductor interface will work harden, which can cause cracks leading to the breaking of the outer conductor. Such situations typically require the replacement of the entire connector assembly.

SUMMARY OF THE INVENTION

An embodiment of the invention includes an electrical connector for coupling a coaxial cable with a connector interface. The electrical connector includes a housing that includes an inner surface and an outer surface, the inner surface defining a longitudinal bore along a longitudinal axis of the housing, the housing having a first end and a second end. The electrical connector further includes a plurality of fingers extending from the first end of the housing to a leading end of the connector, the plurality of fingers having an inner and an outer surface, wherein the plurality of fingers extend axially around a circumference surrounding the longitudinal axis of the connector. The inner surface of the housing includes a first inner diameter region having a first end, a second end, and an inner diameter D1. The inner surface of the housing additionally includes a second inner diameter region having a first end, a second end, and an inner diameter D2, wherein the second inner diameter region is disposed directly adjacent to the first inner diameter region and extends to the first end of the housing. The diameter D2 is less than the diameter D1 such that the first end of the first inner diameter region and the second end of the second inner diameter region define a shoulder facing the second end of the housing. The connector is configured to allow at least a portion of a prepared end of a coaxial cable to be inserted into the second end of the housing and through the first and second inner diameter regions. The prepared end of the coaxial cable includes a center conductor exposed from a first point to a second point, a dielectric layer surrounding the center conductor exposed from the second point to a third point, and an outer conductive layer surrounding the dielectric layer exposed from the third point to a fourth point. The diameter D1 is greater than the outer diameter of the outer conductive layer and the diameter D2 is less than the outer diameter of the outer conductive layer such that the prepared end of the coaxial cable is fully seated in the connecter when a leading end of the outer conductive layer abuts the shoulder and a leading end of the center conductor extends beyond the leading end of the connector.

Another embodiment of the invention includes the electrical connector as described above in combination with a mating connector interface. The mating connector interface includes a housing having an inner surface defining a longitudinal bore along a longitudinal axis of the housing, the housing having a proximal end and a distal end. The mating connector interface also includes a central terminal disposed within the longitudinal bore of the housing, wherein the central terminal is adapted to receive the center conductor of the coaxial cable. In addition, the mating connector interface includes a support member disposed on the inner surface of the housing that holds the central terminal within the longitudinal bore. The inner surface of the mating connector interface includes a tapered portion having a diameter D3 at the distal end of the housing and decreasing in diameter for an axial length L4 to a diameter D4; and a detent disposed between the tapered portion and the proximal end of the housing having a diameter D5, wherein D3>D5>D4.

Another embodiment of the invention includes a method of attaching the electrical connector as described above with a prepared end of a coaxial cable as described above. The method includes inserting at least a portion of the prepared end of the coaxial cable into the second end of the housing of the connector and through the first and second inner diameter regions of the connector. The method next includes fully seating the prepared end of the coaxial cable in the connector by allowing a leading end of the outer conductive layer to abut the shoulder and by allowing a leading end of the center conductor to extend beyond the leading end of the connector. The method further includes soldering at least a portion of the outer surface of the outer conductive layer with at least a portion of the inner surface of the housing.

Another embodiment of the invention includes a method of mating the electrical connector with fully seated and soldered prepared end of a coaxial cable with the mating connector interface as described above. The method includes inserting the leading end of the electrical connector into the distal end of the mating connector interface and through the tapered portion of the housing of the mating connector interface. The method also includes allowing an outer surface of the plurality of fingers to engage the detent disposed within the mating connector.

In a preferred embodiment of the invention, each of the plurality of fingers of the electrical connector has a protrusion disposed at or near the outer surface of the leading end. The protrusion has an outer surface that engages the detent disposed within the mating connector interface when the electrical connector and mating connector interface are fully mated together.

In a preferred embodiment of the invention the central terminal of the mating connector interface includes a female socket contact that includes a plurality of tines. The plurality of tines engage the center conductor of the coaxial cable when the electrical connector and mating connector interface are fully mated together.

In a preferred embodiment of the invention, the mating connector interface is disposed in a bore extending within a multiple-position connector assembly.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1A:
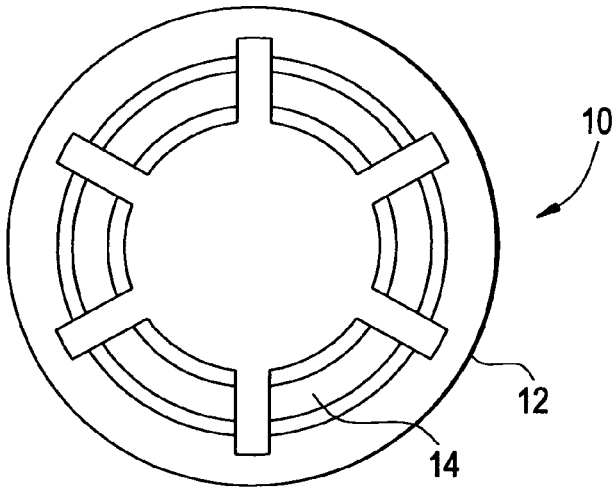
FIG. 1A is a front view of a snap-on electrical connector in accordance with one embodiment of the present invention.

Reference will now be made in detail to the present preferred embodiments of the invention, examples of which are illustrated in the accompanying drawings. Whenever possible, the same reference numerals will be used throughout the drawings to refer to the same or like parts.

Figure 1B:
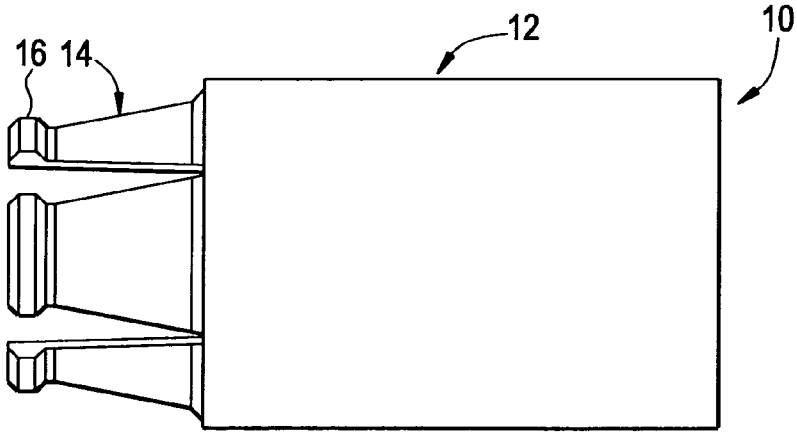
FIG. 1B is a side view of the electrical connector shown in FIG. 1A.
Figure 1C:
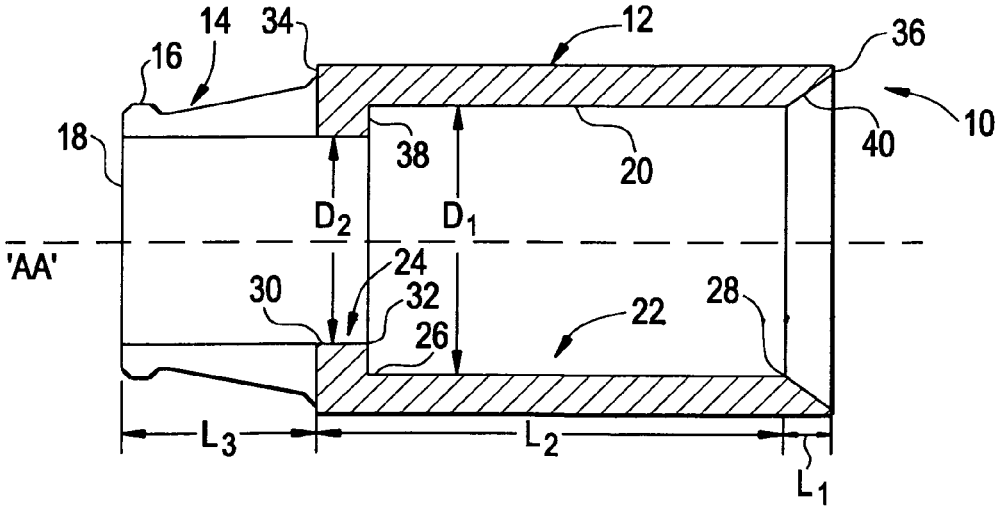
FIG. 1C is a cross-sectional view of the electrical connector shown in FIGS. 1A and 1B.

FIGS. 1A, 1B, and 1C illustrate an embodiment of a snap-on electrical connector 10 in accordance with the present invention. Snap-on connector 10 includes a housing 12 and a plurality of fingers 14 extending an axial length L3 from a first end 34 of the housing to a leading end 18 of the connector, each of the plurality of fingers extending axially around a circumference surrounding the longitudinal axis 'AA' of the connector. In a preferred embodiment, the plurality of fingers 14 comprise a plurality of cantilevered beams separated by a plurality of slots. As shown in FIGS. 1B and 1C, each of the plurality of fingers 14 has a radially outwardly extending protrusion 16 disposed at or near the leading end 18.

As shown in FIG. 1C, housing 12 includes an inner surface 20 having a first inner diameter region 22, having first end 26, second end 28, and an inner diameter D1. Housing 12 further includes a second inner diameter region 24, having first end 30, second end 32, and an inner diameter D2. Second inner diameter region 24 is disposed directly adjacent to first inner diameter region 22 and extends to the first end 34 of housing 12. First and second inner diameter regions have a combined axial length of L2. Inner diameter D2 is less than inner diameter D1 such that the first end 26 of the first inner diameter region 22 and the second end 32 of second inner diameter region 24 define a shoulder 38 facing the second end 36 of housing 12.

As shown in FIG. 1C, inner surface 20 of housing 12 further includes a tapered portion 40 disposed directly adjacent to the second end 28 of the first inner diameter region 22 and increasing in diameter toward the second end of the housing 36 for an axial length L1.

Housing 12 is preferably made of a conductive metal or a conductive metal alloy. Housing 12 can also be plated with one or more metals or metal alloys. In a preferred embodiment, housing 12 is made from beryllium copper (BeCu) covered by nickel plating then covered by gold plating. In a preferred embodiment, the nickel plating has a minimum thickness of 1.27 μm or 50 microinches and the gold plating has a thickness of 1.27 to 2.54 μm or 50 to 100 microinches. In a preferred embodiment the plurality of fingers 14 include the same material as housing 12.

The connector shown in FIGS. 1A-1C is configured to allow at least a portion of a prepared end of a coaxial cable to be inserted into the second end 36 of housing 12 and through the first and second inner diameter regions. The coaxial cable includes a central conductor that is circumferentially surrounded by a dielectric layer, which is circumferentially surrounded by an outer conductive layer, which is circumferentially surrounded by a jacket. The end of the coaxial cable can be prepared by first removing a portion of a cable jacket to expose the outer conductive layer. Then a portion of the exposed outer conductive layer can be removed to expose the dielectric layer. Then a portion of the exposed dielectric layer can be removed to expose the center conductor. Thus, the prepared end of the coaxial cable includes a center conductor exposed from a first point to a second point, a dielectric layer surrounding the center conductor exposed from the second point to a third point, and an outer conductive layer surrounding the dielectric layer exposed from a third point to a fourth point.

Figure 2:
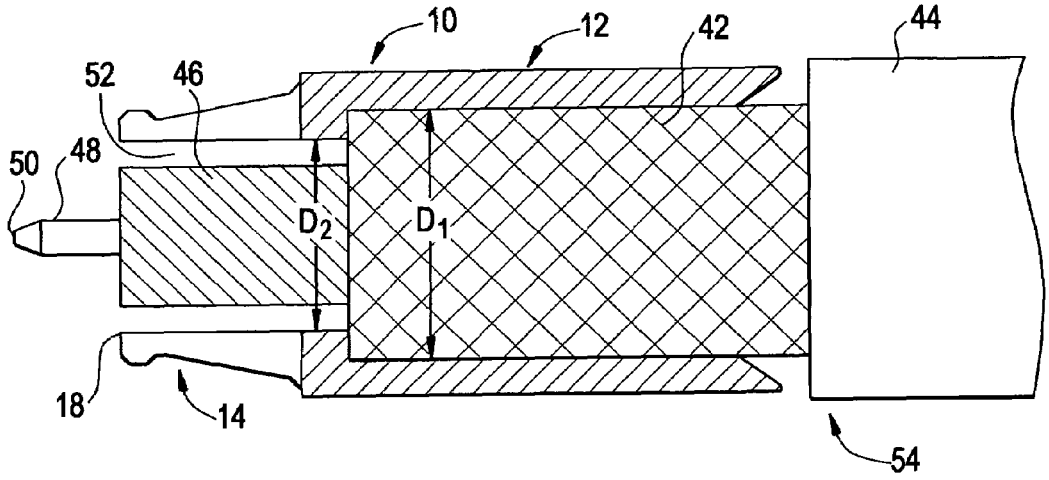
FIG. 2 is a cross-sectional view of a snap-on electrical connector in accordance with one embodiment of the present invention wherein a prepared end of a coaxial cable is fully seated in the connector.

FIG. 2 illustrates a cross-sectional view of a prepared end of a coaxial cable 54 that is fully seated in connector 10. As shown in FIG. 2, the diameter D1 is greater than the outer diameter of an outer conductive layer 42 of the coaxial cable and the diameter D2 is less than the outer diameter of the outer conductive layer 42 of the coaxial cable. The diameter D1 is less than the outer diameter of a jacket 44 of the coaxial cable and the diameter D2 is greater than the outer diameter of a dielectric layer 46 of the coaxial cable. The prepared end of the coaxial cable is fully seated in connector 10 when, as shown in FIG. 2, a leading end of the outer conductive layer 42 abuts shoulder 38 and a leading end 50 of a center conductor 48 of the coaxial cable 54 extends beyond the leading end 18 of connector 10. In a preferred embodiment, substantially the entire exposed portion of center conductor 48 extends beyond the leading end 18 of connector 10 when the prepared end of the coaxial cable 54 is fully seated in the connector 10, such as the entire exposed portion of center conductor 48 extending beyond a leading end 18 of connector 10 when the prepared end of the coaxial cable 54 is fully seated in the connector 10.

In preferred embodiments, connector 10 is sized to accept a coaxial cable 54 of the 50-ohm, 0.047-inch flexible type. For other size connectors, an 0.086 inch flex cable may be used. Accordingly, in preferred embodiments D1 is less than 0.090 inches, such as less than 0.060 inches, and even further such as less than 0.045 inches. Alternatively, connector 10 can be used with other sizes and types of coaxial cables, in which case connector 10 can be sized accordingly.

In preferred embodiments, the plurality of fingers 14 collectively provide an inner diameter of about D2 when in the unbiased state. In preferred embodiments, the plurality of fingers 14 are capable of being flexed radially inward when subjected to an external inward-biasing force and have sufficient resiliency to return to their unbiased state when the external inward-biasing force is removed. In preferred embodiments, the inner diameter of the plurality of fingers 14 in the unbiased state is greater than the outer diameter of dielectric layer 46 to the extent that a gap 52 is provided between the inner diameter of the plurality of fingers 14 and the outer diameter of dielectric layer 46 when prepared end of the coaxial cable 54 is fully seated in connector 10 (as shown in FIG. 2). In preferred embodiments, the difference between the inner diameter of the plurality of fingers 14 and the outer diameter of dielectric layer 46 is from 0.01 inch to 0.001 inch, such as from 0.005 inch to 0.002 inch, such that when the prepared end of the coaxial cable 54 is fully seated and centered in connector 10 the radial width of gap 52 is from 0.005 inch to 0.0005 inch, such as from 0.0025 inch to 0.001 inch.

Once the prepared end of a coaxial cable 54 is fully seated in connector 10, at least a portion of the outer surface of outer conductive layer 42 is soldered with at least a portion of the inner surface 20 of housing 12. In a preferred embodiment, inner surface 20 of housing 12 can be soldered to the outer surface of conductive layer 42 using Sn63 solder (not shown).

Figure 3:
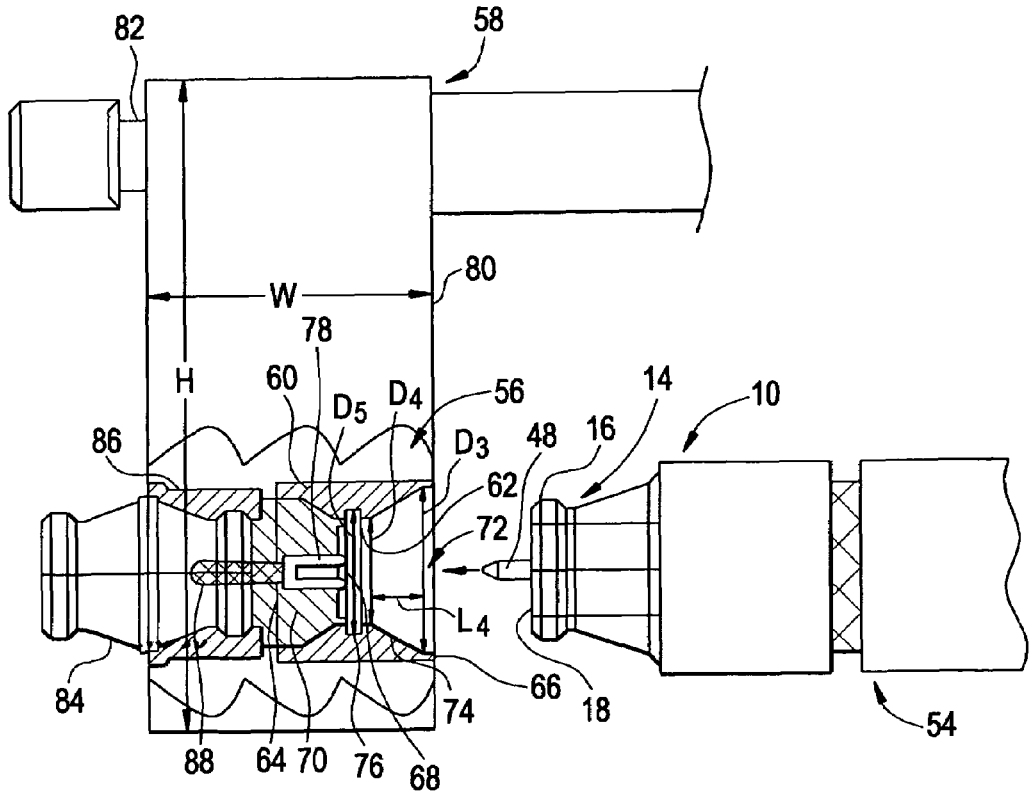
FIG. 3 shows a partial cross-sectional view of a mating connector interface that is disposed within a bore extending within a multiple-position connector assembly prior to the insertion of a snap-on electrical connector in the mating connector interface.

After soldering, connector 10 can be mated with a mating connector interface. FIG. 3 shows a partial cross-sectional view of a mating connector interface 56 that is disposed within a bore extending within a multiple-position connector assembly 58 prior to the insertion of connector 10 in the mating connector interface 56. Connector 10 houses the prepared end of a coaxial cable 54 wherein an exposed portion of center conductor 48 extends beyond the leading end 18 of connector 10. Mating connector interface 56 includes a housing 60 including an inner surface 62 defining a longitudinal bore 72 along a longitudinal axis of the housing 60, the housing having a proximal end 64 and a distal end 66. A central terminal 68 is disposed within the longitudinal bore 72 of housing 60. Central terminal 68 is adapted to receive center conductor 48 of coaxial cable 54. A support member 70 is disposed on inner surface 62 of housing 60 and holds the central terminal 68 within the longitudinal bore 72. Inner surface 62 includes a tapered portion 74 having a diameter D3 at the distal end 66 of housing 60 and decreasing in diameter for an axial length L4 to a diameter D4. Inner surface 62 further includes a detent 76 (i.e., a groove circumferentially cut into inner surface 62) disposed between tapered portion 74 and proximal end 64 of housing 60. Detent 76 defines an inner diameter D5. Inner diameter D5 is preferably greater than D4 and less than D3.

In preferred embodiments, D3 is less than 0.05 inches, D4 is less than 0.04 inches and D5 is less than 0.045 inches. In preferred embodiments, $0.65 \leqq D4/D3 \leqq 0.75$ and $0.75 \leqq D5/D3 \leqq 0.85$.

In preferred embodiments, central terminal 68 includes a female socket contact that includes a plurality of tines 78. Tines 78 are preferably cantilevered and adapted to engage center conductor 48 of coaxial cable 54. Central terminal 68 is preferably constructed of a metal or metal alloy such as brass, copper, Kovar®, or stainless steel.

Housing 60 is made from an electrically conductive material, preferably a metal or metal alloy. In preferred embodiments, housing 60 is made from brass, copper, Kovar®, or stainless steel.

Support member 70 is preferably made from a dielectric material, such as polytetrafluoroethylene (PTFE) or glass, such as Corning 7070 glass.

As shown in FIG. 3, mating connector interface 56 is disposed within a bore extending within a multiple-position connector assembly 58. The multiple-position connector assembly 58 includes an assembly housing 80 and a fastening mechanism 82 to allow the connector assembly to be securely fastened to another object. The assembly housing 80 is preferably a metal or metal alloy, such as aluminum alloy 6061-T6, which is a preferred material for aerospace applications, where weight reduction is important. The dimensions of assembly housing 80 are not limited and can be expected to vary depending on the number of interfaces in the housing. In preferred embodiments, assembly housing 80 has a width W of from 0.15 to 0.30 inches, such as from 0.20 to 0.25 inches. In preferred embodiments, assembly housing 80 has a height H of from 0.30 to 0.60 inches, such as from 0.40 to 0.50 inches. In preferred embodiments, assembly housing 80 has a length (not shown) of from 0.8 inches to 1.5 inches, such as from 1 inch to 1.25 inches. Assembly housing 80 preferably includes a plurality of bores (not shown) for housing a plurality of connector interfaces. In a preferred embodiment, assembly housing 80 includes between 4 and 16 bores for housing an equivalent number of connector interfaces. In a particularly preferred embodiment, assembly housing 80 includes eight closely spaced bores for housing eight connector interfaces.

In a preferred embodiment a blind mate interconnect or bullet 84 can be inserted into a shroud 86 on the opposite side of assembly housing 80 as connector interface 56. Shroud 86 houses male pin 88 that can be engaged by female socket contact (not shown) of bullet 84 thereby establishing electrical and mechanical communication between bullet 84 and male pin 88.

Connector 10 is mated with mating connector interface 56 by inserting the leading end 18 of the connector 10 into distal end 66 of inner surface 62, through tapered portion 74, and by allowing an outer surface of protrusion 16 to engage detent 76. Tapered portion 74 preferably decreases to an inner diameter that is less than the maximum outer diameter (in the unbiased state) of the plurality of protrusions 16 such that when protrusions 16 are passed through tapered portion 74, the plurality of fingers 14 are flexed radially inward and, due to their resilient nature, impart a biasing force against the inner surface of tapered portion 74. Such biasing force causes connector 10 to snap into place when the outer surfaces of protrusions 16 engage the inner surface of detent 76.

Simultaneously, center conductor 48 of coaxial cable 54 is received in central terminal 68, which, in a preferred embodiment, includes a female socket contact that includes a plurality of tines 78. Preferably the tines 78 are cantilevered and grip center conductor 48 when connector 10 and mating connector interface 56 are in full mating engagement.

Figure 4:
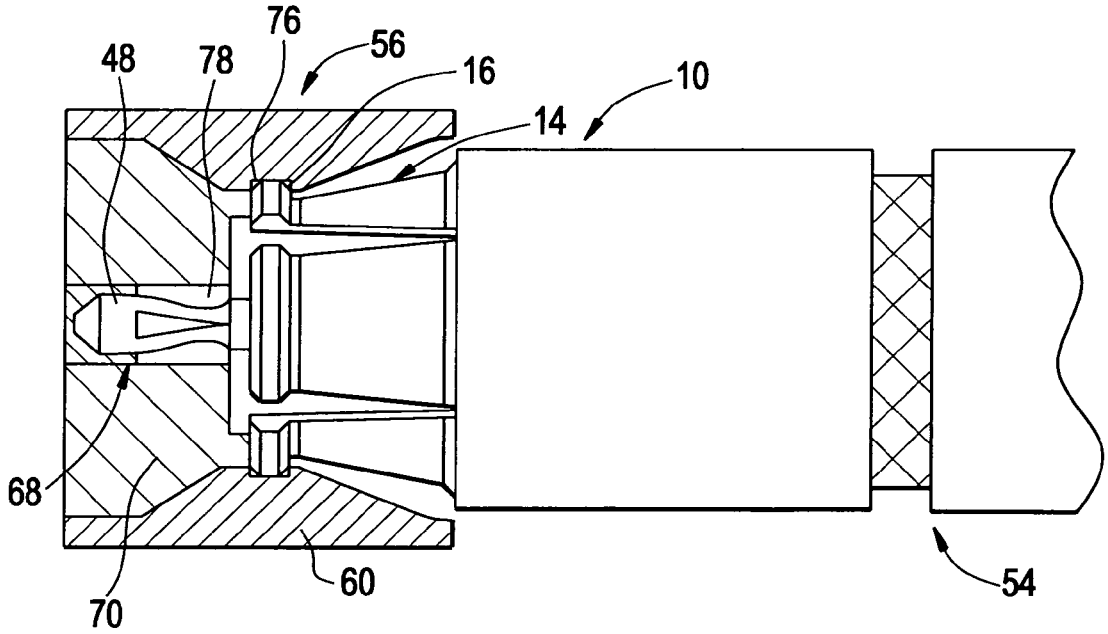
FIG. 4 shows an enlarged cross-sectional view of a snap-on electrical connector and a prepared end of a coaxial cable in mating engagement with a mating connector interface.

FIG. 4 shows an enlarged cross-sectional view of connector 10 and prepared end of a coaxial cable 54 in full mating engagement with mating connector interface 56. Mating connector interface 56 includes housing 60 that houses central terminal 68 and support member 70. As can be seen in FIG. 4, when full mating engagement is achieved, the outer surface of protrusion 16 engages the inner surface of detent 76. As can be further seen in FIG. 4, when full mating engagement is achieved, tines 78 engage the center conductor 48 of the coaxial cable 54. In the embodiment shown in FIG. 4, each of the plurality of fingers 14 are flexed radially inward when connector 10 is in full mating engagement with mating connector interface 56. In an alternative embodiment (not shown), detent 76 and the plurality of fingers 14 may be mutually adapted to allow the inner surfaces of the plurality of fingers 14 to lie parallel to an outer surface of the dielectric layer of the coaxial cable when connector 10 and mating connector interface 56 are fully mated together.

When connector 10 is in fully mating engagement with mating connector interface 56, at least the outer surface of protrusion 16 is electrically coupled to housing 60 and center conductor 48 of coaxial cable 54 is electrically coupled to central terminal 68.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An electrical connector for coupling a coaxial cable with a connector interface, the electrical connector comprising:

a housing comprising an inner surface and an outer surface, the inner surface defining a longitudinal bore along a longitudinal axis of the housing, the housing having a first end and a second end; and a plurality of fingers extending from the first end of the housing to a leading end of the connector, each of the plurality of fingers having an inner and an outer surface, wherein the plurality of fingers extend axially around a circumference surrounding the longitudinal axis of the connector;

wherein the inner surface of the housing comprises:

a first inner diameter region having a first end, a second end, and an inner diameter D1;

a second inner diameter region having a first end, a second end, and an inner diameter D2, wherein the second inner diameter region is disposed directly adjacent to the first inner diameter region and extends to the first end of the housing;

wherein D2<D1, such that the first end of the first inner diameter region and the second end of the second inner diameter region define a shoulder facing the second end of the housing; and wherein the connector is configured to allow at least a portion of a prepared end of the coaxial cable to be inserted into the second end of the housing and through the first and second inner diameter regions, the prepared end of the coaxial cable comprising a center conductor exposed from a first point to a second point, a dielectric layer surrounding the center conductor exposed from the second point to a third point, and an outer conductive layer surrounding the dielectric layer exposed from the third point to a fourth point; and wherein D1 is greater than the outer diameter of the outer conductive layer and D2 is less than the outer diameter of the outer conductive layer such that the prepared end of the coaxial cable is fully seated in the connector when a leading end of the outer conductive layer abuts the shoulder and a leading end of the center conductor extends beyond the leading end of the connector.

2. The electrical connector of claim 1, wherein $0.85 \leqq D2/D1 \leqq 0.95$.

3. The electrical connector of claim 2, wherein D1 is less than 0.05 inches.

4. The electrical connector of claim 1, wherein the inner surface of the housing further comprises a tapered portion disposed directly adjacent to the second end of the first inner diameter region and increasing in diameter toward the second end of the housing for an axial length L1.

5. The electrical connector of claim 1, wherein the plurality of fingers have an inner diameter of D2 when in the unbiased state.

6. The electrical connector of claim 1, wherein each of the plurality of fingers has a protrusion disposed at or near the outer surface of the leading end.

7. The combination of the electrical connector of claim 6 and a mating connector interface, the interface comprising:

a housing comprising an inner surface defining a longitudinal bore along a longitudinal axis of the housing, the housing having a proximal end and a distal end;

a central terminal disposed within the longitudinal bore of the housing, wherein the central terminal is adapted to receive the center conductor of the coaxial cable; and a support member disposed on the inner surface of the housing and holding the central terminal within the longitudinal bore;

wherein the inner surface comprises a tapered portion having a diameter D3 at the distal end of the housing and decreasing in diameter for an axial length L4 to a diameter D4;

and a detent disposed between the tapered portion and the proximal end of the housing having a diameter D5, wherein D3>D5>D4.

8. The combination of claim 7, wherein the protrusion has an outer surface that engages the detent when the electrical connector and mating connector interface are fully mated together.

9. The combination of claim 7, wherein the central terminal comprises a female socket contact comprising a plurality of tines.

10. The combination of claim 9, wherein the plurality of tines engage the center conductor of the coaxial cable when the electrical connector and mating connector interface are fully mated together.

11. The combination of claim 7, wherein the detent and the plurality of fingers are mutually adapted to allow the inner surfaces of the plurality of fingers to lie parallel to an outer surface of the dielectric layer when the electrical connector and mating connector interface are fully mated together.

12. The combination of claim 7, wherein $0.65 \leqq D4/D3 \leqq 0.75$ and $0.75 \leqq D5/D3 \leqq 0.85$.

13. The combination of claim 7, wherein the mating connector interface is disposed in a bore extending within a multiple-position connector assembly.

14. A method of attaching a prepared end of a coaxial cable to an electrical connector, the electrical connector comprising:

a housing comprising an inner surface and an outer surface, the inner surface defining a longitudinal bore along a longitudinal axis of the housing, the housing having a first end and a second end; and a plurality of fingers extending from the first end of the housing to a leading end of the connector, each of the plurality of fingers having an inner and an outer surface, wherein the plurality of fingers extend axially around a circumference surrounding the longitudinal axis of the connector;

wherein the inner surface of the housing comprises:

a first inner diameter region having a first end, a second end, and an inner diameter D1;

a second inner diameter region having a first end, a second end, and an inner diameter D2, wherein the second inner diameter region is disposed directly adjacent to the first inner diameter region and extends to the first end of the housing;

wherein D2<D1, such that the first end of the first inner diameter region and the second end of the second inner diameter region define a shoulder facing the second end of the housing; and the prepared end of the coaxial cable comprising a center conductor exposed from a first point to a second point, a dielectric layer surrounding the center conductor exposed from the second point to a third point, and an outer conductive layer surrounding the dielectric layer exposed from the third point to a fourth point;

wherein the method comprises:

inserting at least a portion of the prepared end of the coaxial cable into the second end of the housing and through the first and second inner diameter regions;

fully seating the prepared end of the coaxial cable in the connector by allowing a leading end of the outer conductive layer to abut the shoulder and allowing a leading end of the center conductor to extend beyond the leading end of the connector; and soldering at least a portion of the outer surface of the outer conductive layer with at least a portion of the inner surface of the housing.

15. The method of claim 14, wherein each of the plurality of fingers has a protrusion disposed at or near the outer surface of the leading end.

16. The method of claim 15, wherein the method further comprises mating the electrical connector with a mating connector interface, the mating connector interface comprising:

a housing comprising an inner surface defining a longitudinal bore along a longitudinal axis of the housing, the housing having a proximal end and a distal end;

a central terminal disposed within the longitudinal bore of the housing, wherein the central terminal is adapted to receive the center conductor of the coaxial cable; and a support member disposed on the inner surface of the housing and holding the central terminal within the longitudinal bore;

wherein the inner surface comprises a tapered portion having a diameter D3 at the distal end of the housing and decreasing in diameter for an axial length L4 to a diameter D4;

and a detent disposed between the tapered portion and the proximal end of the housing having a diameter D5, wherein D3>D5>D4;

wherein the method further comprises:

inserting the leading end of the electrical connector into the distal end and through the tapered portion of the housing of the mating connector interface; and allowing an outer surface of the protrusion to engage the detent.

17. The method of claim 16, wherein the central terminal comprises a female socket contact comprising a plurality of tines.

18. The method of claim 17, wherein the plurality of tines engage the center conductor of the coaxial cable when the electrical connector and mating connector interface are fully mated together.

19. The combination of claim 16, wherein the mating connector interface is disposed in a bore extending within a multiple-position connector assembly.

* * * * *